US006155777A

United States Patent [19]

Aschenbruck et al.

[11] Patent Number: 6,155,777

[45] Date of Patent: Dec. 5, 2000

[54] REMOVAL OF COOLING AIR ON THE HOUSING SIDE OF A DIFFUSER OF A COMPRESSOR STAGE OF GAS TURBINES

[75] Inventors: Emil Aschenbruck, Duisburg; Hildegard Ebbing, Oberhausen; Hans Otto Jeske, Reppenstedt; Ulrich Orth, Bottrop; Harald Schönenborn, Wuppertal, all of Germany

[73] Assignee: GHH Borsig Tubomaschinen GmbH, Oberhausen, Germany

[21] Appl. No.: 09/256,575

[22] Filed: Feb. 24, 1999

[30] Foreign Application Priority Data

Apr. 1, 1998 [DE] Germany ..... 198 14 627

[51] Int. Cl.[7] ..... F01D 9/06

[52] U.S. Cl. ..... 415/115; 415/208.3; 415/226; 415/914

[58] Field of Search ..... 415/115, 208.2, 415/208.3, 208.4, 211.1, 226, 914; 60/751

[56] References Cited

U.S. PATENT DOCUMENTS

| | | | |
|---|---|---|---|
| 2,778,204 | 1/1957 | Frank . | |
| 4,131,389 | 12/1978 | Perrone et al. | 415/211 |
| 4,368,005 | 1/1983 | Exley et al. | 415/207 |
| 4,761,947 | 8/1988 | Hennecke et al. | 415/115 |
| 5,207,559 | 5/1993 | Clevenger et al. | 415/166 |

FOREIGN PATENT DOCUMENTS

| | | |
|---|---|---|
| 11 99 541 | 8/1965 | Germany . |
| 43 26 799 A1 | 2/1995 | Germany . |
| 11 19 479 | 7/1968 | United Kingdom . |

OTHER PUBLICATIONS

Jack D. Mattingly, 1996, *Elements of Gas Turbine Propulsion, McGraw Hill International Editions Mechanical Engineering Series.*

*Primary Examiner*—Edward K. Look
*Assistant Examiner*—Liam McDowell
*Attorney, Agent, or Firm*—McGlew and Tuttle, P.C.

[57] ABSTRACT

The removal of cooling air from the diffuser part of a radial end stage of a compressor of a gas turbine is provided. Compressed air is removed via a cooling air discharge (10) from a radial compressor stage, which comprises a rotor disk (2) and a bladed diffuser (20). The removal of cooling air may be brought about such that the cooling air is removed on one side through openings (6) on the housing side (20.1) of the diffuser (20) and is fed through cooling air channels (10) to the parts in contact with hot gas, including the outer wall of the bifurcated tube (17). The compressed air is guided to the diffuser outside (20.2) through cooling air holes (19) in the diffuser blade (3).

16 Claims, 3 Drawing Sheets

REMOVAL OF COOLING AIR ON THE HOUSING SIDE OF A DIFFUSER OF A COMPRESSOR STAGE OF GAS TURBINES

FIELD OF THE INVENTION

The present invention pertains to the removal of cooling air from the diffuser part of a radial end stage of a compressor of a gas turbine.

BACKGROUND OF THE INVENTION

Cooling air, which is removed from the compressor under high pressure, is needed to cool the components that are in contact with hot gas in a gas turbine, which comprises a compressor, a combustion means and a turbine.

In a gas turbine developed by the applicant, compressed air is removed from a radial stage of a compressor, which is an end stage in this case, through the housing wall in the diffuser part, which wall is arranged on the side of the annular space.

This cooling air is removed from the radial compressor stage, which comprises a rotor disk and a diffuser, which may be either bladed or unbladed. In the case of a bladed diffuser, the cooling air removed is transported within the diffuser vanes through horizontal holes in the direction of the outside of the diffuser. A deadwater space, which reduces the efficiency of the entire compressor stage, frequently develops in such a diffuser near the housing wall.

SUMMARY AND OBJECTS OF THE INVENTION

The primary object of the present invention is to design the removal of cooling air in the compressor part of a gas turbine such that favorable effects on the compressor efficiency are achieved from a fluidic viewpoint.

According to the invention cooling air from the diffuser part of a radial end stage of a compressor of a gas turbine is removed. This is achieved by providing at least one opening arranged circularly between the diffuser vanes in the diffuser housing side in the area of a cooling air discharge provided in a housing wall of an annular space adjacent to the discharge.

The openings may be provided as round holes. The openings may also be slots extending in the radial direction. The openings may also be slots extending in the circumferential direction.

Due to the device according to the present invention, the removal of cooling air is brought about such that the compressed cooling air is removed through openings in the form of holes or slots on the housing side of the diffuser and the side wall boundary layer is thus drawn off.

The openings may be designed either as round holes or as slots extending in the radial direction or extending in the circumferential direction. The formation of a deadwater area is prevented or at least greatly reduced as a result, which increases the efficiency of the entire stage.

As a whole, it is achieved by the device according to the present invention that a deadwater area is avoided, which leads to a reduction in the losses in the diffusor and to an increase in the efficiency of the stage.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
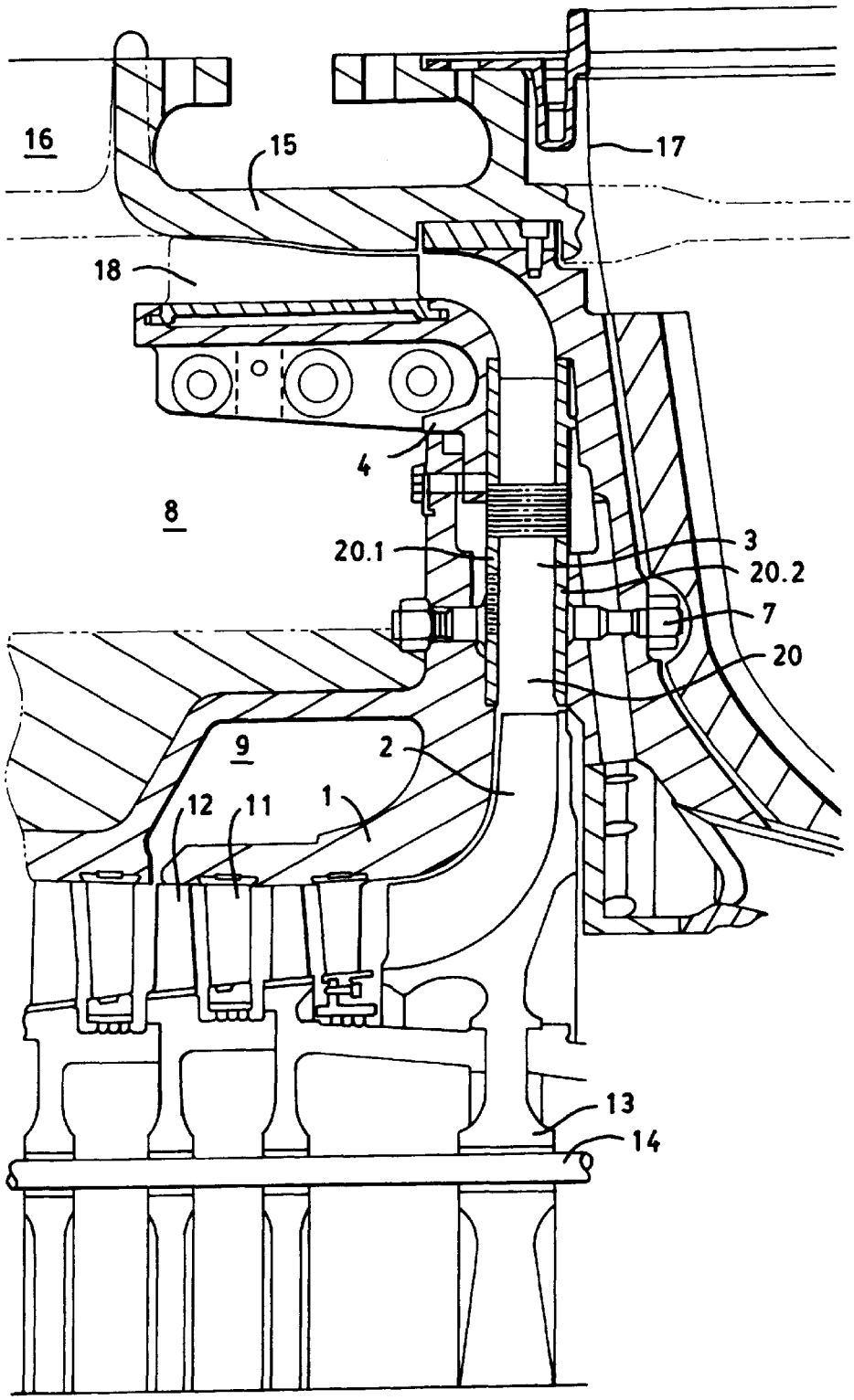
FIG. 1 is a longitudinal sectional view through the compressor part of a gas turbine in the area of the diffuser.

Referring to the drawings in particular, FIG. 1 shows a longitudinal section through a compressor of a gas turbine with parts of the annular space 8, the guide vane interior space 9, the compressor housing 15 and the discharge opening 16 for the compressed air, which is fed to the combustion chamber of the gas turbine.

The rotor blades 12 of the compressor are fastened to the rotor disks 13, which are held together by a plurality of tie rods 14. Guide vanes 11 are fastened in the vane support 1. The end stage of the compressor comprises a radial stage with a radial rotor disk 2, a diffuser with blades (vanes)3 and an axial guide vane 18. The compressed air then enters the annular space 8.

In such a gas turbine, which comprises a compressor, a combustion means and a turbine, cooling air is needed to cool the components coming into contact with hot gas, and this cooling air is removed from the compressor under high pressure.

Figure 2:
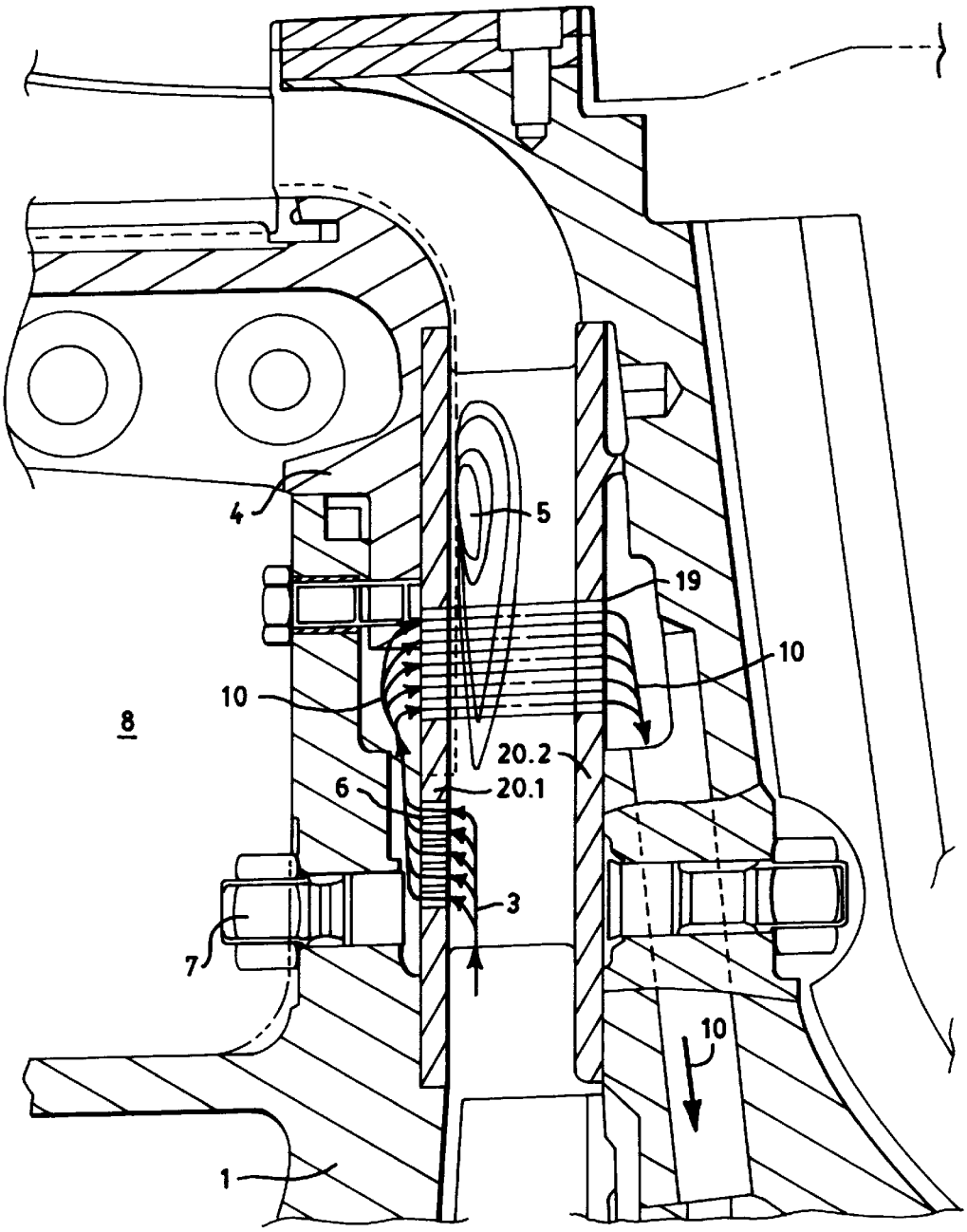
FIG. 2 is an enlarged view of the diffuser according to FIG. 1.

FIG. 2 shows an enlarged view of the diffuser from FIG. 1. With the corresponding fastening elements 7, the diffuser blading (diffuser vanes) 3 is also used at the same time to connect the vane support 1 to the housing wall of the annular space 4.

A deadwater area 5, which reduces the efficiency of the entire compressor stage, frequently develops in such a diffuser 20 near the housing wall 4 on the diffuser housing side 20.1.

Compressed air is removed via a cooling air discharge 10 from a radial compressor stage, which comprises a rotor disk 2 and a diffuser 20, which may be either bladed or unbladed.

The removal of cooling air is therefore brought about according to the present invention such that the cooling air is removed on one side through openings 6 on the housing side 20.1 of the diffuser 20 and is fed through cooling air channels 10 to the parts in contact with hot gas, including also the outer wall of the bifurcated tube 17.

In the case of a bladed diffuser, the air is guided through cooling air holes 19 in the diffuser blade 3 to the diffuser outside 20.2. In the case of an unbladed diffuser 20, the cooling air must be transported to the diffuser outside by other suitable means.

Figure 3:
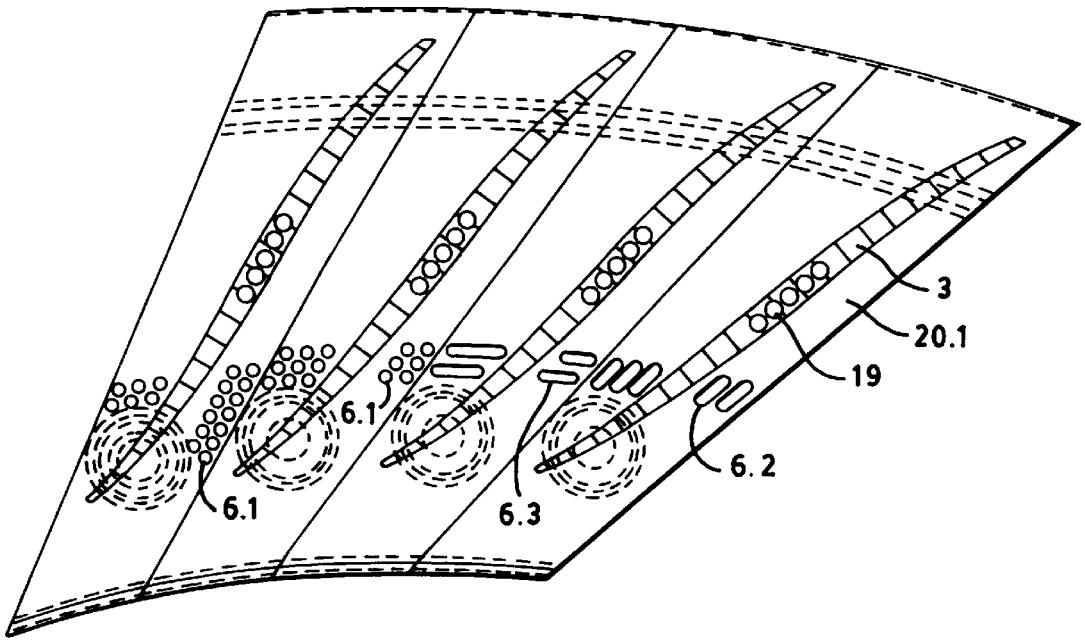
FIG. 3 is a partially sectional view of the diffuser blades and the housing wall in the diffuser area with different exemplary embodiments of the removal of cooling air.

FIG. 3 shows a view of the housing wall in the diffuser area with various exemplary embodiments of the removal of cooling air on one side through openings 6 on the housing side 20.1 of the diffuser 20. The openings 6 are provided in any one of the three hole types 6.1, 6.2, and 6.3 or in combinations thereof. The removal may take place either through holes 6.1., through slots extending radially 6.2, or through slots extending in the circumferential direction 6.3.

While specific embodiments of the invention have been shown and described in detail to illustrate the application of the principles of the invention, it will be understood that the invention may be embodied otherwise without departing from such principles.

List of Reference Numbers

| | |
|---|---|
| 1 | Vane support |
| 2 | Rotor disk, radial |
| 3 | Diffuser vane |
| 4 | Housing wall |
| 5 | Deadwater in 20 |
| 6 | Openings in 20.1 |
| 6.1 | Holes |
| 6.2 | Slots, extending in the radial direction |
| 6.3 | Slots, extending in the circumferential direction |
| 7 | Fastening elements |
| 8 | Annular space |
| 9 | Vane support interior space |
| 10 | Cooling air discharge |
| 11 | Guide vane |
| 12 | Guide vane |
| 13 | Rotor disk |
| 14 | Tie rod |
| 15 | Compressor housing |
| 16 | Discharge opening |
| 17 | Bifurcated tube |
| 18 | Axial deflecting blades |
| 19 | Holes in 3 |
| 20 | Diffuser |
| 20.1 | Diffuser, housing side |
| 20.2 | Diffuser, outside |

What is claimed is:

1. A gas turbine compressor radial end stage diffuser part with cooling air removal, comprising:

a housing wall defining an annular air circulation space, the housing wall having a cooling air discharge;

a diffuser housing having sides;

diffuser vanes in said diffuser housing; and openings arranged in a side of said diffuser housing in an area of said cooling air discharge.

2. The diffuser part in accordance with claim 1, wherein said openings are round holes.

3. The diffuser part in accordance with claim 1, wherein said openings are slots extending in a radial direction of the gas turbine compressor radial end stage.

4. The diffuser part in accordance with claim 1, wherein said openings are slots extending in a circumferential direction of the gas turbine compressor radial end stage.

5. A gas turbine compressor radial end stage, comprising:

a compressor housing with a discharge opening;

a housing wall defining an annular air circulation space within said compressor housing, said annular air circulation space being in fluid communication with said discharge opening, said housing wall having a cooling air discharge;

a diffuser housing having sides;

diffuser vanes in said diffuser housing; and openings arranged in a side of said diffuser housing.

6. The gas turbine compressor radial end stage in accordance with claim 5, wherein said openings are round holes.

7. The gas turbine compressor radial end stage in accordance with claim 5, wherein said openings are slots extending in a radial direction of the gas turbine compressor radial end stage.

8. The gas turbine compressor radial end stage in accordance with claim 5, wherein said openings are slots extending in a circumferential direction of the gas turbine compressor radial end stage.

9. The gas turbine compressor radial end stage in accordance with claim 5, further comprising a passage connecting said openings and said housing wall cooling air discharge.

10. The gas turbine compressor radial end stage in accordance with claim 9, wherein said passage comprises a plurality of cooling air holes formed in a diffuser blade.

11. A gas turbine compressor radial end stage, comprising:

a compressor housing with a discharge opening;

a housing wall defining an annular air circulation space within said compressor housing, said annular air circulation space being in fluid communication with said discharge opening, said housing wall having a plurality of cooling air discharge channels;

compressor rotor blades radially inwardly of said annular space;

a radial compressor end stage with a radial rotor disk and a diffuser with a diffuser housing having sides and diffuser vanes; and openings arranged in a side of said diffuser housing, each of said openings being in fluid communication with one of said air discharge channels.

12. The gas turbine compressor radial end stage in accordance with claim 11, wherein said openings are round holes.

13. The gas turbine compressor radial end stage in accordance with claim 11, wherein said openings are slots extending in a radial direction of the gas turbine compressor radial end stage.

14. The gas turbine compressor radial end stage in accordance with claim 11, wherein said openings are slots extending in a circumferential direction of the gas turbine compressor radial end stage.

15. The gas turbine compressor radial end stage in accordance with claim 11, further comprising a passage connecting said openings and said housing wall cooling air discharge channels to provide said fluid communication between said openings and said channels.

16. The gas turbine compressor radial end stage in accordance with claim 15, wherein said passage comprises a plurality of cooling air holes formed in said diffuser blades.

* * * * *

UNITED STATES PATENT AND TRADEMARK OFFICE

CERTIFICATE OF CORRECTION

PATENT NO. : 6,155,777
DATED : December 5, 2000
INVENTOR(S) : Aschenbruck et al.

It is certified that error appears in the above-identified patent and that said Letters Patent is hereby corrected as shown below:

Title page,
Item [73], the Assignee should read as follows:
-- [73] Assignee: GHH BORSIG Turbomaschinen GmbH
Oberhausen, Germany --

Signed and Sealed this

Twentieth Day of August, 2002

*Attest:*

*Attesting Officer*

JAMES E. ROGAN
*Director of the United States Patent and Trademark Office*